US007473074B2

(12) United States Patent
Herbst et al.

(10) Patent No.: US 7,473,074 B2
(45) Date of Patent: Jan. 6, 2009

(54) EXHAUST FAN

(75) Inventors: Walter Herbst, Lake Forest, IL (US); James C. Hand, Glen Ellyn, IL (US)

(73) Assignee: Intelligent Home Products, Inc., Clveland, OH (US)

( * ) Notice: Subject to any disclaimer, the term of this patent is extended or adjusted under 35 U.S.C. 154(b) by 363 days.

(21) Appl. No.: 11/352,802

(22) Filed: Feb. 13, 2006

(65) Prior Publication Data

US 2007/0189891 A1 Aug. 16, 2007

(51) Int. Cl.
*F04D 29/44* (2006.01)

(52) U.S. Cl. ..... 415/213.1; 415/116; 415/214.1

(58) Field of Classification Search ..... 415/116, 415/213.1, 214.1; 416/5
See application file for complete search history.

(56) References Cited

U.S. PATENT DOCUMENTS 4,122,329 A * 10/1978 Godel ..... 392/384
4,471,753 A 9/1984 Yates
5,042,457 A 8/1991 Gallagher
5,127,479 A 7/1992 Stehling
5,297,636 A 3/1994 North
5,495,859 A 3/1996 Bowen
5,497,791 A 3/1996 Bowen
5,585,047 A * 12/1996 Mortensen et al. ..... 261/109
5,638,833 A 6/1997 Bowen
5,752,527 A 5/1998 Bowen
5,879,232 A * 3/1999 Luter et al. ..... 454/349
5,934,362 A * 8/1999 Barker, II ..... 165/48.1
6,585,486 B2 * 7/2003 Birdsell et al. ..... 415/213.1
6,776,708 B1 8/2004 Daoutis

* cited by examiner

*Primary Examiner*—Igor Kershteyn
(74) *Attorney, Agent, or Firm*—Fay Sharpe LLP

(57) ABSTRACT

The subject invention relates to a fan housing, comprising a unitary molded structure formed from a material that has a flame spread rating of twenty five or less. The unitary molded structure comprises a base, an impeller housing centrally located next to the base, and a flow path located circumferentially around the impeller housing with one or more defined walls for directing air flow. An exhaust port receives air from the flow path and outputs air in a particular direction.

20 Claims, 5 Drawing Sheets

EXHAUST FAN

BACKGROUND

Unwanted moisture, stale air, odors, etc. can accumulate within enclosed spaces. In one example, moisture from steam can accumulate within a bathroom. The moisture can cause paint to peel, doors to warp and the accumulation of mold spores. A simple exhaust fan can greatly reduce or eliminate various problems created by excess moisture. In such cases, a ventilation device such as an exhaust fan can be employed to draw air containing unwanted moisture, odors, etc. out of the enclosed space and expelled into another area such as the surrounding atmosphere.

Ventilation devices have been available for many years. Many of these products are recessed in a ceiling and connected to a duct leading to the exterior of a home or other structure. A basic ventilation device includes an electrical enclosure and a fan driven by an electric motor. Typically, the device is switched so that a user may energize the motor, causing the fan to draw air through a grill and the air via a duct to the outside atmosphere.

Conventional ventilation devices employ a metallic enclosure to house the electronics that drive the ventilation device. Additionally, metallic materials are employed for entire ventilation device housing. However, there are several drawbacks to utilizing a metal enclosure such as excessive noise, heat dissipation, heat retention, inefficient air flow, etc. What are needed are systems and methods that address shortcomings associated with conventional ventilation device design.

BRIEF DESCRIPTION

According to one aspect of the subject invention, fan housing comprises a unitary molded structure formed from a material that has a flame spread rating of twenty five or less. The unitary molded structure comprises a base, an impeller housing centrally located next to the base, and a flow path located circumferentially around the impeller housing with one or more defined walls for directing air flow. An exhaust port receives air from the flow path and outputs air in a particular direction.

According to another aspect of the subject invention, a ventilation fan comprises a unitary molded fan housing formed from a material that has a flame spread rating of twenty five or less and an impeller having at least one fan blade and mounted to the unitary fan housing. An impeller motor is coupled to the impeller that rotates the impeller to draw air into the fan housing. A power supply provides power to the impeller motor.

According to yet another aspect of the subject invention, a method is employed to manufacture a bathroom fan. A unitary housing unit is formed with a phenolic material that has a flame spread rating of twenty five or less. An impeller that comprises at least one fan blade within the unitary fan housing, an impeller motor coupled to the impeller that rotates the impeller to draw air into the fan housing, and a power supply that provides power to the impeller motor are incorporated into the unitary housing unit.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

DETAILED DESCRIPTION

Figure 1:
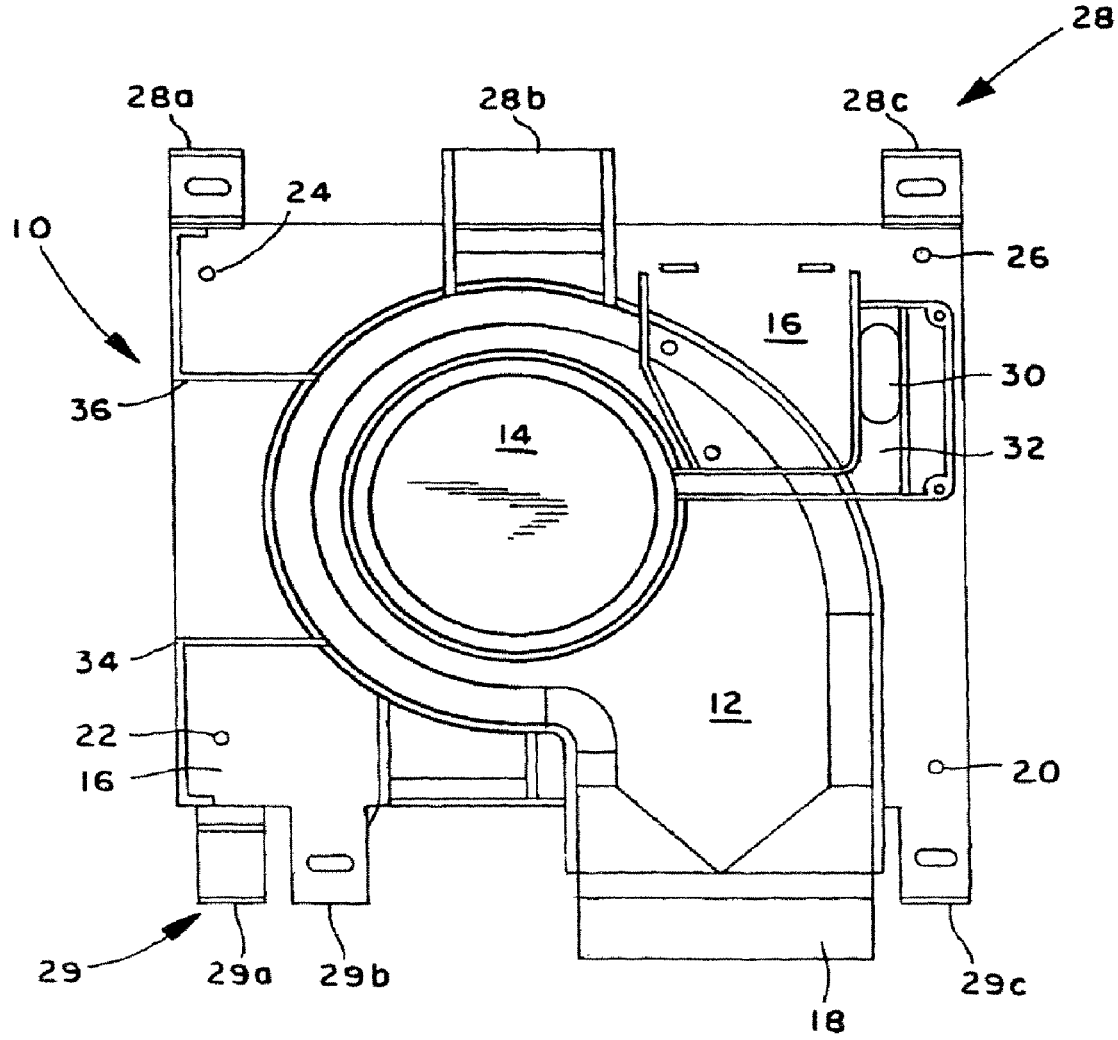
FIG. 1 is a top view of a fan housing in accordance with an exemplary embodiment.

FIG. 1 illustrates a top view of a fan housing 10, which can be comprised of substantially the same material throughout. The fan housing 10 includes a flow path 12, an impeller housing 14, and an electrical enclosure 16. The impeller housing 14 can house an impeller (not shown) that draws air from a space into the flow path 12 and expels this air through an exhaust port 18. As shown, the flow path 12 is located circumferentially around the impeller housing 14. Mounting holes 20, 22, 24, and 26 can be employed to mount the fan housing 10 to one or more structures.

The fan housing 10 can be constructed of a phenolic, a thermoplastic, a thermoset, an elastomer, a plastic, a resin, etc. In one example, the fan housing 10 is constructed of a two-stage injection molded mineral filled phenolic. Such material can conform to any number of suitable standards promulgated by one or more standardizing bodies (e.g., UL, ASTM, ANSI, etc.). In another example, the fan housing 10 is constructed of a phenolic molding compound. Such material can meet particular specifications (e.g., UL 507, etc.) that specify flame spread and smoke developed requirements for non-metallic enclosures and other parts of permanently connected equipment.

The fan housing 10 can be a unitary molded structure. Such molded structure can increase the efficiency of the air flow based on the integral form and/or function of the flow path 12. A more efficient air flow requires less impeller power to draw air through the fan housing such that a smaller impeller motor can be employed than conventional means. In addition, air can be drawn through the fan housing at a higher rate since the pressure behind the impeller fan will be lower due to increased air flow efficiency.

In one embodiment, the fan housing 10 is a unitary molded structure that defines walls for the flow path 14. This unitary molded structure can employ soft forms at corners and other features to efficiently channel air through the flow path 12. Soft forms are possible since molding is employed to manufacture the fan housing 10. Soft forms are distinguished over harsh corners created when manufacturing conventional steel housings by bending, folding, etc. manufacturing operations. Thus, a linear air flow can be created that mitigates excessive and/or inefficient flows.

In addition, utilizing a unitary molded housing can reduce noise levels since a limited number of parts are employed. The linear air flow path created by a molded housing can also contribute to a reduction in noise level. For example, air traveling across a smooth surface can produce less noise than air traveling across one or more harsh surfaces such as corners or other irregular features. In addition, use of polymer materials (e.g., in place of metal) for various components can help reduce noise levels. Such noise level reduction can be measured in one or more units such as sones, phons, etc.

Mounting holes 20, 22, 24, and 26 are located within proximity of the corners of the fan housing 10. The mounting holes 20-26 allow one or more components (e.g., screws, nails, rivets, etc.) to couple the fan housing 10 to a flat surface such as a wall or ceiling, for example. In one example, screws fasten the fan housing 10 to one or more joists via the mounting holes 20-26.

A first support brace channel 28 includes components 28*a*, 28*b* and 28*c* that can be employed to hold a first brace (not shown) secured to one or more structures such as a cross member in a ceiling, for example. In one example, the components 28*a* and 28*c* can support the brace from a first side, while the component 28*b* supports the brace from a second side, symmetric to the first. In this manner, a brace can be slid through the channel created by components 28*a*, 28*b* and 28*c*. Similarly, a second support brace channel 29 includes components 29*a*, 29*b* and 29*c* that can be employed to provide support for a second brace (not shown) secured to one or more mounting structures. In one embodiment, components 29*b* and 29*c* support the brace from a first side while 29*a* supports the brace from a second side. In this manner, a brace can be slid through the channel created by components 29*a*, 29*b* and 29*c*.

A mounting hole 30 accommodates an electrical (e.g., via conduit, etc.) and/or other connection to one or more electrical components (not shown) within the electrical enclosure 16. A steel plate 32 can surround the mounting hole 30 to facilitate an attachment for the conduit. In some instance, the steel plate 32 may be required to meet one or more building and/or material standards as set forth by United Laboratories (UL), American Society for Testing and Materials (ASTM), American National Standards Institute (ANSI), etc.

Support fins 34 and 36 can provide additional structural stability to the fan housing 10 in general and the impeller housing 14 in particular. The support fins 34 and 36 can extend to the outer edge of the fan housing 10. In one embodiment, the support fins 34 and 36 can further extend down the length of the fan housing to the corners (e.g., where mounting holes 22 and 24 are located). The support fins 34 and 36 can be substantially the same height as the impeller housing 14. Further, vertical surface mounting holes (not shown) can be located on the surface of the support fins 34 and 36 that face the outer edge of the fan housing 10. Such mounting holes can be employed to mount the fan housing to a joist or other structural member to provide stability.

Figure 2:
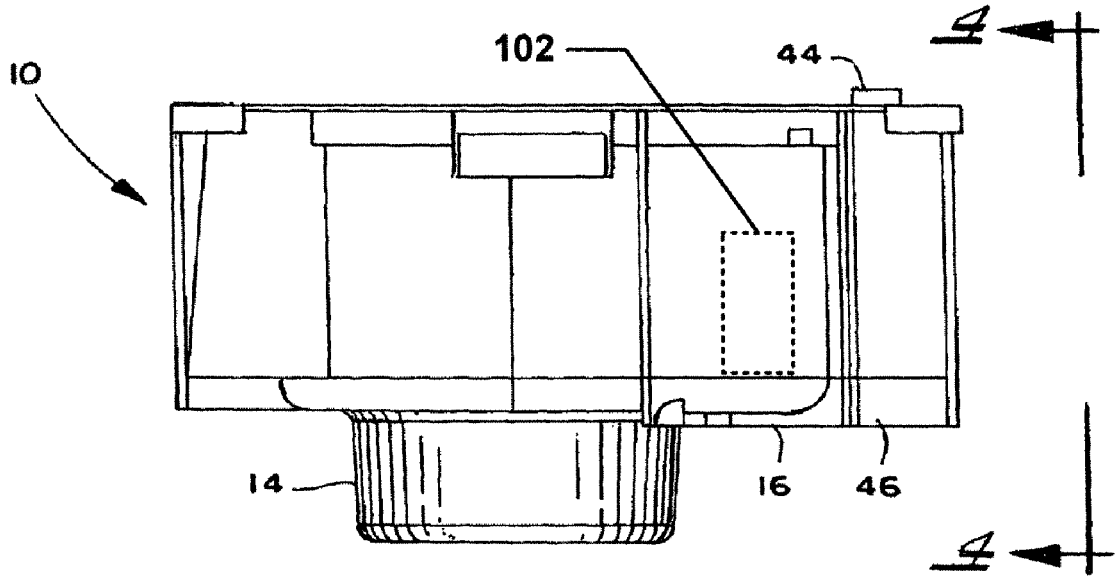
FIG. 2 is a side elevation of a fan housing in accordance with an exemplary embodiment.

FIG. 2 illustrates a side elevation of the fan housing 10 which shows the impeller housing 14, the electrical enclosure 16, the cross brace bracket 28, a wiring channel 44, and a PC board slot 46. The wiring channel 44 is a raised feature located between the electrical enclosure 16 and the impeller housing 14. The wiring channel 44 can allow cables or other connective wires to pass from the electrical enclosure 16 to one or more electrical components (not shown) within the impeller housing (e.g., an impeller motor, etc.). For example, a power cable (not shown) from a power supply 102 and a control cable (not shown) from a microprocessor can be connected to an impeller to provide power and control the speed of the impeller rotation.

The PC board slot 46 is located adjacent to the electrical enclosure 16 and can be comprised of four side walls and a bottom with an open top. A PC board (not shown) can be positioned in the PC board slot 46 via the open top. The PC board can be utilized for processing data and/or control of one or more components associated with the fan housing 10. In one embodiment, the PC board can provide power to the impeller and/or light (not shown) on a periodic basis, based on the time of day, etc. In another approach, the PC board can control one or more disparate components associated with the fan housing 10 such as an air cleaner, a filter, a heating element, etc.

Figure 3:
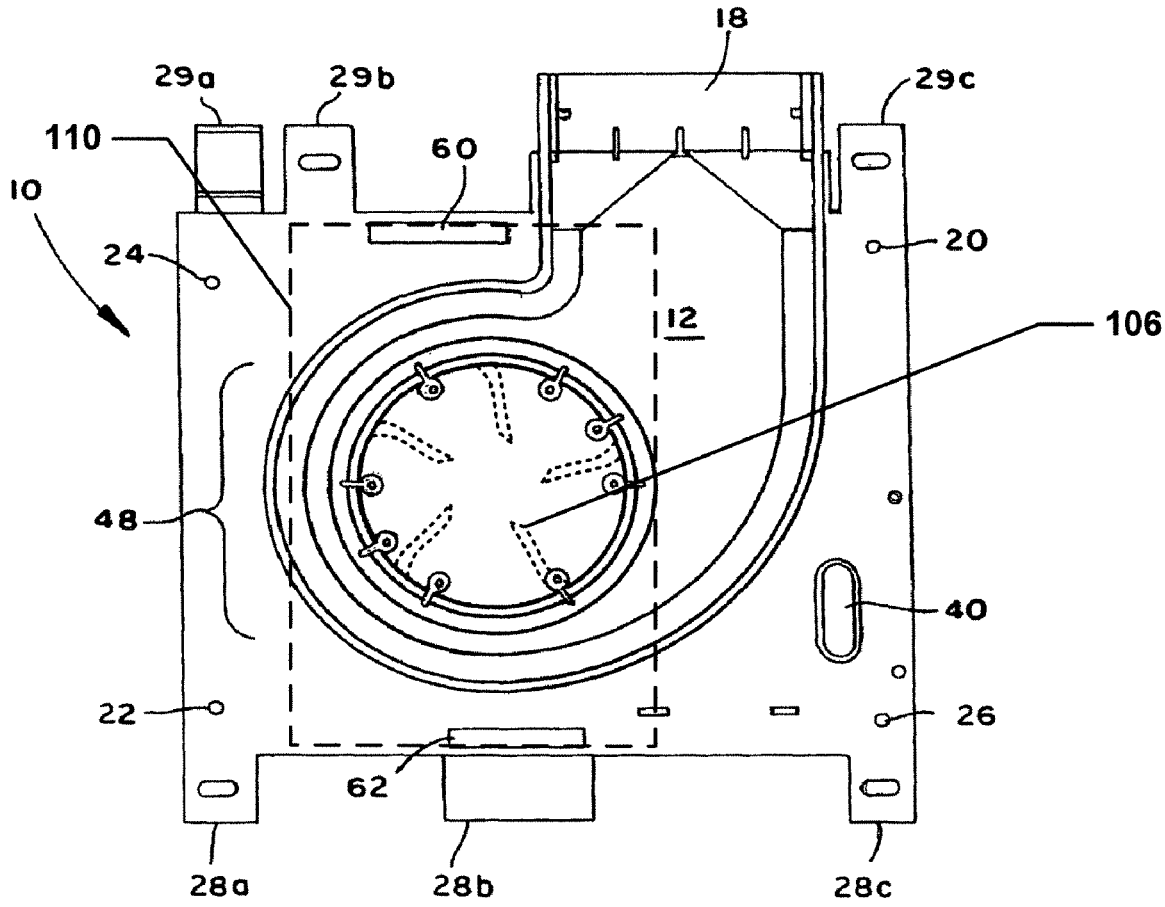
FIG. 3 is a bottom view of a fan housing in accordance with an exemplary embodiment.

FIG. 3 illustrates a bottom view of the fan housing 10 which includes a wiring portal 40, an impeller motor mounting boss 48, and wire spring clip catches 60 and 62. The wiring portal 40 can accommodate one or more electrical lines and/or other connection from the electrical enclosure 16. In this manner, power can be provided to one or more auxiliary components such as a light, an air filtration unit, etc., which are mounted to the fan housing 10. Such power can be provided to the one or more auxiliary components by passing a conduit, wire, cable, etc. through the wiring portal 40 from the one or more electrical components (not shown) within the electrical enclosure 16.

The impeller motor mounting boss 48 can include one or more motor mounts for mounting one or more different motors to the impeller housing 14. Additionally, the motor mounts can employ motion dampening devices such as rubber stoppers, gaskets, etc. to dampen motion associated with the impeller. In one embodiment, the fan housing 10 is designed to accommodate two different motor types wherein each motor has different mounting hole locations. In this instance, the motor mounting boss 48 can allow either motor to be mounted to the fan housing 10.

The wire spring clip catches 60 and 62 are located on the front and back side of the fan housing 10. A clip (not shown) or other member can be inserted into each of the wire spring clip catches 60 and 62 to couple at least one component to the fan housing 10. In one example, a light fixture 116 includes two clips that are inserted into each of the wire spring clip catches 60 and 62 to couple the light fixture to the fan housing 10. The clips may have a protrusion that can lock the members into place once inserted in the wire spring clip catches 60 and 62. In another example, at least one of a vent, a filter 110, a diffuser, etc. can be coupled to the fan housing 10 via the wire spring clip catches 60 and 62.

Figure 4:
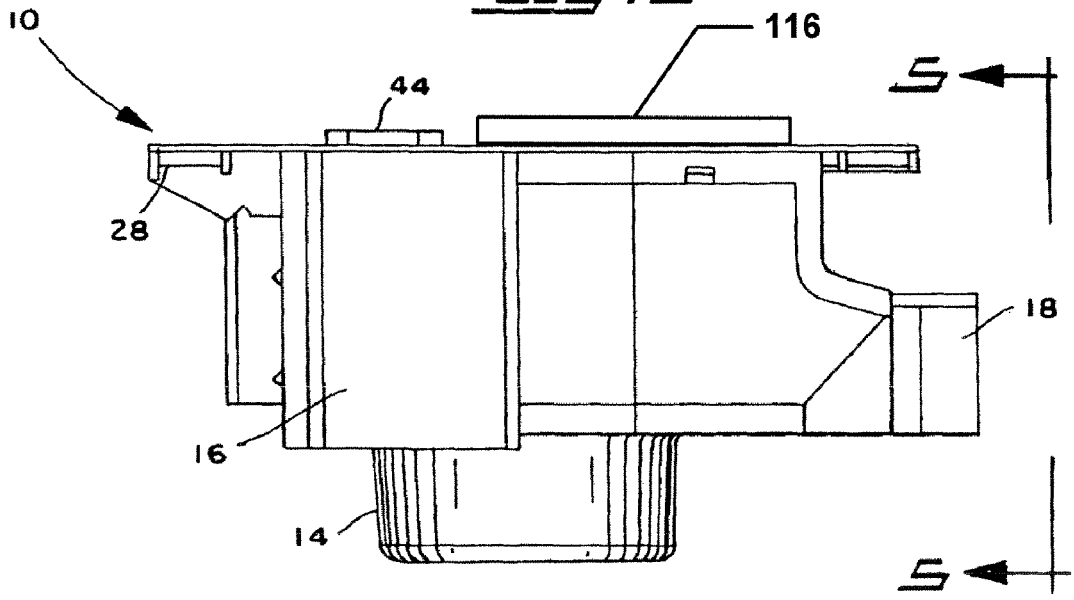
FIG. 4 is side elevation of a fan housing in accordance with an exemplary embodiment.
Figure 5:
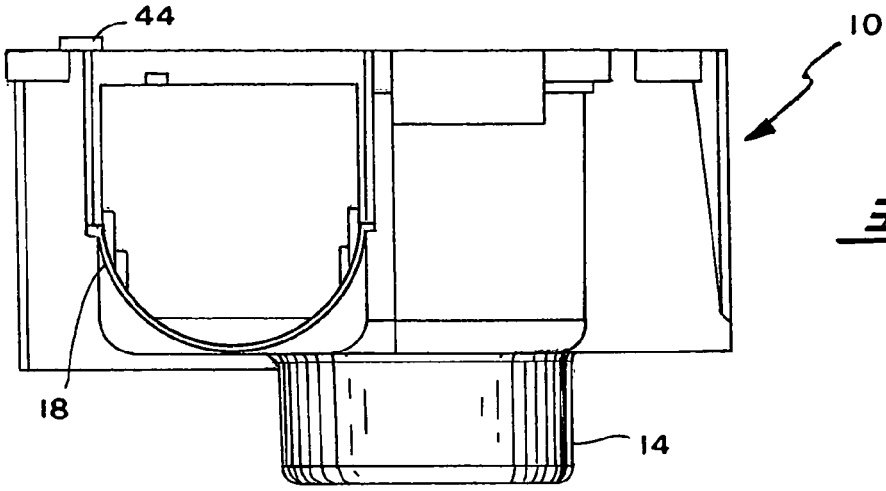
FIG. 5 is side elevation of a fan housing in accordance with an exemplary embodiment.

FIG. 4 illustrates a side elevation of the fan housing 10 shown in FIG. 3. Further illustrated are the impeller housing 14, the electrical enclosure 16, the exhaust port 18, the cross brace bracket 28, and the wiring channel 44. FIG. 5 illustrates a side elevation of the fan housing 10 shown in FIG. 4. The impeller housing 14, the exhaust port 18, and the wiring channel 44 are shown. This embodiment further illustrates the front of the exhaust port 18. In this embodiment, a one-half cylinder shape is shown wherein a fan housing cover is not attached.

Figure 6:
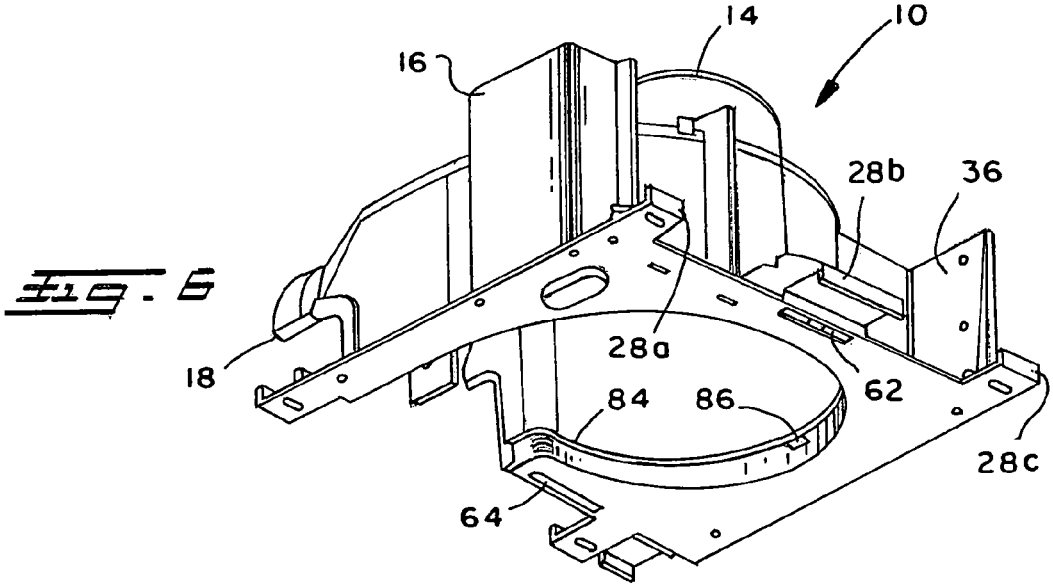
FIG. 6 is an isometric view of a fan housing in accordance with an exemplary embodiment.
Figure 7:
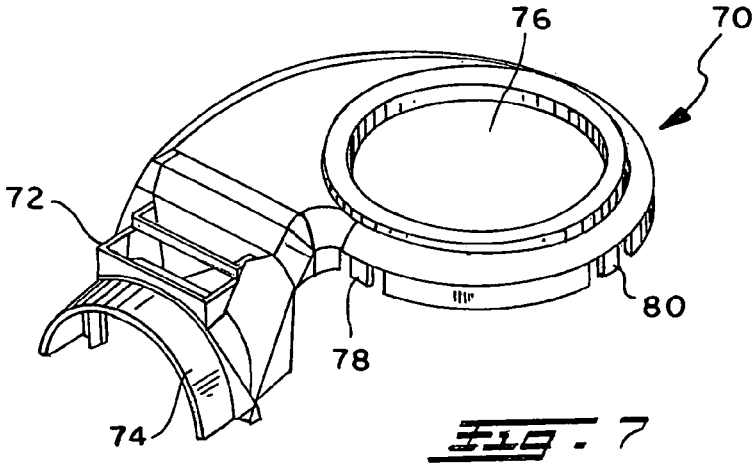
FIG. 7 is an isometric view of a fan housing cover in accordance with an exemplary embodiment.

FIG. 6 illustrates an isometric view of the fan housing 10 including the impeller housing 14, the electrical enclosure 16, the exhaust port 18, the cross brace bracket components 28*a*, 28*b* and 28*c*, the wiring portal 40, the wire spring clip catches 62 and 64. Further included are snap inserts 84 and 86 which can accommodate one or more snaps (not shown). Additional snap inserts (not shown) can also be employed to accommodate one or more additional snaps. FIG. 7 illustrates another isometric view of the fan housing 10 which includes the impeller housing 14, the electrical enclosure 16, the exhaust port 18, the support brace channel components 29*a* 29*b* and 29*c*, the support fins 34 and 36 and the wire spring clip catch 62.

Figure 8:
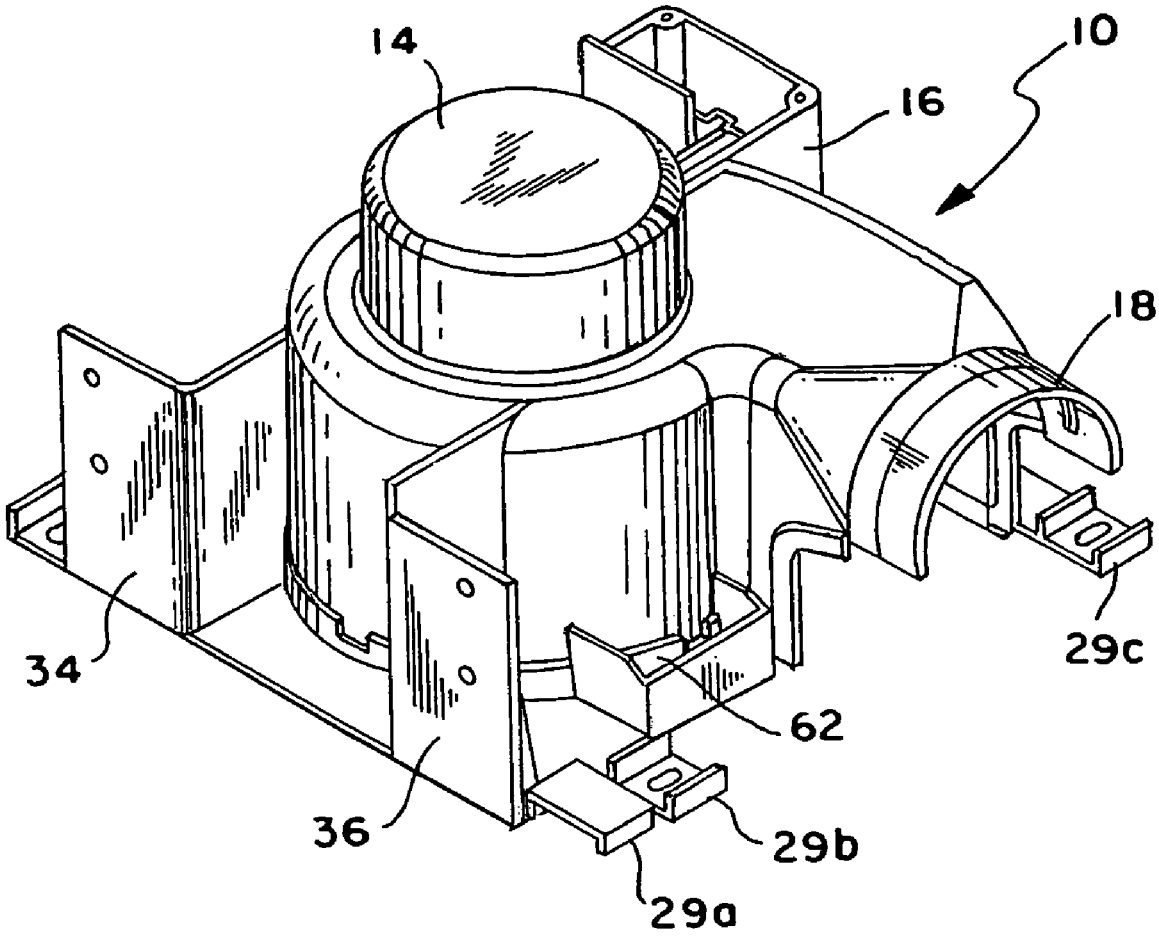
FIG. 8 is an isometric view of a fan housing in accordance with an exemplary embodiment.

FIG. 8 illustrates a fan housing cover 70 which includes a brace support 72, an exhaust port cover 74 and an input port 76. The fan housing cover 70 further includes snaps 78 and 80 that can be employed to couple the fan housing cover 70 to the fan housing 10. The fan housing cover 70 can include substantially any profile to provide a desired air flow when attached to the exhaust port. The fan housing cover 70 can be designed to attach to the fan housing 10 to enclose the flow path 12 and the exhaust port 18.

In one embodiment, the fan housing cover 70 can be attached to the fan housing 10 via one or more snap inserts that can accept snaps 78 and 80. Although two snaps are illustrated it is to be appreciated that a plurality of snaps (and snap inserts) can be employed to couple to the fan housing cover 70. An impeller (not shown) can be placed inside the input port 76 to draw air into the fan housing 10. Fan blades 106 or other impeller attachments can be enclosed by the fan housing cover 70 to prevent injury from the rotating fan blades and further to provide a cosmetic addition to the fan housing 10.

Various materials that meet one or more standards (e.g., as set forth by UL, ANSI, ASTM, etc.) can be employed to manufacture the fan housing 10. For example, a standard (e.g., UL 507, etc.) that relates to the flame spread and smoke developed requirements for non-metallic enclosures and other parts of permanently connected equipment. This standard can provide that a non-metallic enclosure or part that provides a barrier between a building cavity and internal parts of a fan, that is intended to be permanently connected electrically, shall have a flame spread rating of zero in accordance with a particular standard (e.g., UL 723, the standard for test for surface burning characteristics of building materials, etc.).

If the material employed to construct the fan housing 10 does not meet a particular standard (e.g., UL 507, etc.), an exception that nevertheless complies with the standard can be substituted. For example, if the fan housing 10 material has a flame spread rating of twenty-five or less, as determined by a standard test method (e.g., ASTM E162, etc.) for surface flammability of materials using a radiant heat energy source. In one exemplary embodiment, the flame spread rating can be determined by utilizing a radiant heat source consisting of a twelve by eighteen inch panel in front of which an inclined six by eighteen inch specimen of the material to be tested is placed. The specimen is oriented so that ignition is forced near its upper edge and the flame front progresses downward. The factor derived from the rate of progress of the flame front (ignition properties) and another relating to the rate of heat liberation by the material under test are combined to provide a flame spread rating.

Figure 9:
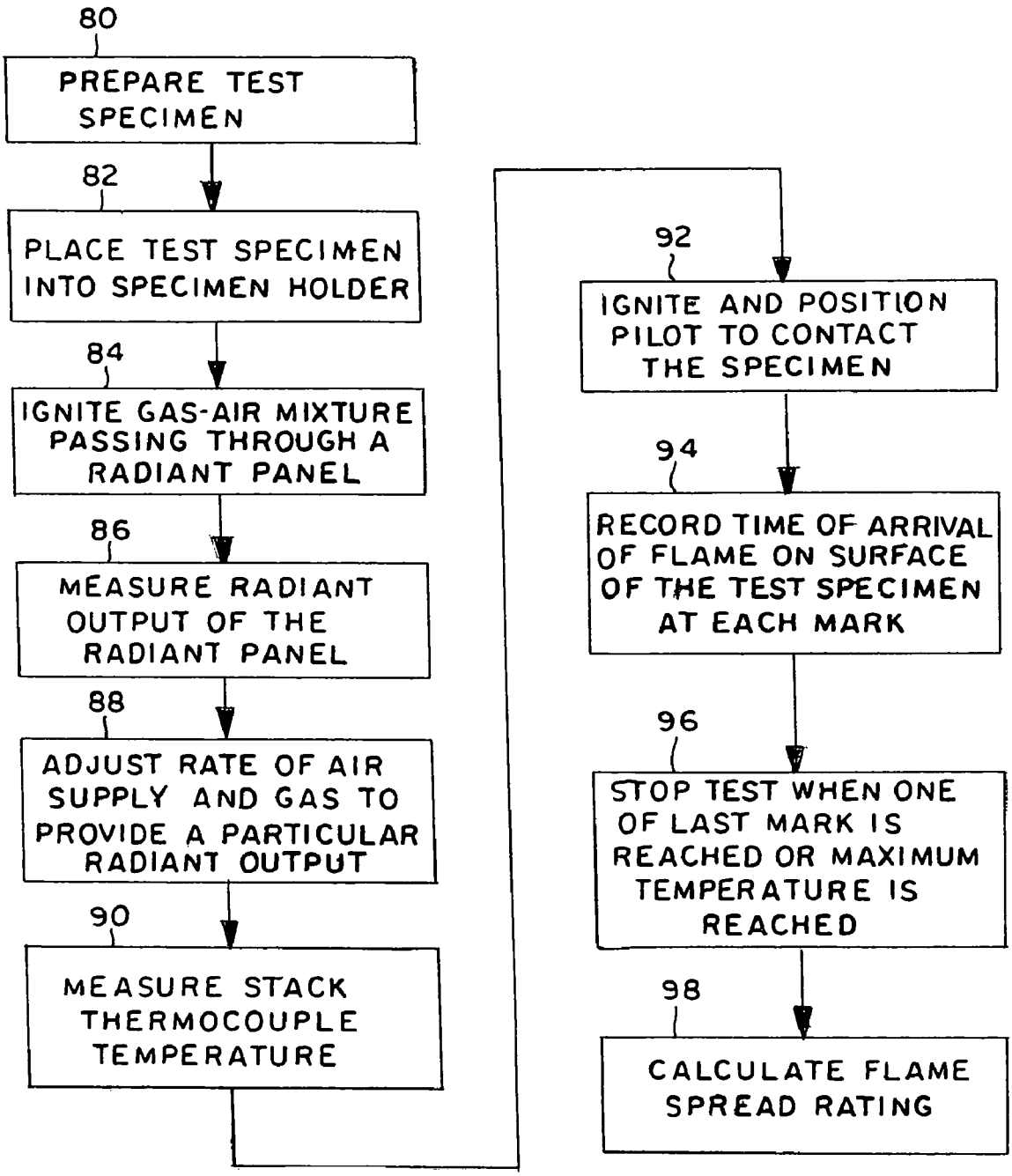
FIG. 9 illustrates a methodology for calculating the flame spread rating of a material in accordance with an exemplary embodiment.

While, for purposes of simplicity of explanation, the methodologies of FIG. 9 is shown and described as executing serially, it is to be understood and appreciated that the present invention is not limited by the illustrated order, as some aspects could, in accordance with the present invention, occur in different orders and/or concurrently with other aspects from that shown and described herein. Moreover, not all illustrated features may be required to implement a methodology in accordance with an aspect the present invention.

FIG. 9 describes a testing procedure to determine the flame spread rating, $I_s$, of a material employed with a bathroom fan. It is to be appreciated that the flame spread rating can be determined utilizing alternate testing procedures. In one example, a bathroom fan can be manufactured by forming a unitary housing unit with a phenolic material that has a flame spread rating of twenty five or less. An impeller that comprises at least one fan blade within the unitary fan housing, an impeller motor coupled to the impeller that rotates the impeller to draw air into the fan housing, and a power supply that provides power to the impeller motor can be incorporated into the unitary housing unit.

Test Specimen At reference numeral 80, the test specimen is prepared. The test specimen shall have a height of about six inches, a length of about eighteen inches and a thickness of about one inch. Materials supplied at a thickness greater than one inch shall be cut to one inch for testing. Materials greater than one inch thickness can be tested by using an oversized specimen holder. Sheet materials that are opaque to infrared radiation and greater than one-sixteenth inch thickness are not applied to a base (e.g., hardboard, etc.). Opaque sheet materials up to one-sixteenth inch thickness shall be applied to one-quarter inch thick tempered hardboard using recommended application procedures. The hardboard shall have a mean flame-spread index of one hundred and thirty to one hundred and sixty based upon a minimum of four tests performed in accordance with this method.

For cellular elastomers and cellular plastics, whether flexible or not, the back and sides of the test specimen shall be wrapped with aluminum foil two thousandths of an inch thick, with the bright side against the specimen. High density inorganic reinforced cement board, one quarter inch in thickness, shall be used as backing. The test specimen shall be retained in the specimen holder by a six by eighteen inch sheet of nominally one inch hexagonal steel wire mesh, twenty AWG, placed against the exposed face of the specimen. Molded skin or treated surfaces shall face the exposure. Materials that tend to delaminate or in any way separate from the specimen holder during the above test exposure shall be retested using one or more specimens in which the material is retained in position by a six by eighteen inch sheet of one inch hexagonal wire mesh placed in the specimen holder and against the exposed face of the specimen. If, in this initial test, any material tends to melt, soften, crack, split, or fall from the specimen holder, it shall be retested with a wire support as described above and the higher of the two results shall be adopted as the flame spread index. All specimens except those over three quarter inch thick shall be backed with one half inch millboard of sixty $lb/ft^3$ density. To protect the back surface of the specimen, a one by six inch strip of flexible ceramic paper shall be placed across the top edge of the specimen and folded down over the back face of the millboard. Four test specimens of each sample shall be tested. If one or more tests are deemed to be invalid, additional tests shall be conducted until four valid test results have been developed.

Procedure At 82, place the test specimen into the test holder. Remove combustion product deposits from the thermocouples by brush-cleaning or other effective method after each test. During the conduct of the test, control extraneous drafts by closing windows and doors, stop air-circulating devices, and arrange baffles between the apparatus and any remaining sources of drafts. At 84, ignite the gas-air mixture passing through the radiant panel and allow the unit to heat for one half hour. At 86, check the radiant output by means of the radiation pyrometer. Do this by placing the pyrometer in such a manner as to view a central panel area about ten inches in diameter.

At 88, adjust the rate of air supply to between seven hundred and fifty and eight hundred $ft^3$/hour and then adjust the fuel gas supply upwards from zero until it is just sufficient to produce a radiant output equal to that which would be obtained from a blackbody of the same dimensions operating at a temperature of 1238±7° F. At 90, turn on the recording potentiometer for measuring the stack thermocouple temperature. The adequacy of measures to control drafts shall be established by ensuring that stack temperature variations before the specimen is put in place for test do not exceed 69° F. At 92, ignite the pilot and adjust it to give a flame two to three inches long and move the pilot into operating position. The pilot burner shall remain ignited and in position for the duration of the test whether or not there is flaming of the specimen. For materials that tend to shrink or contract upon application of heat, position the pilot burner flame to directly contact the specimen. Place the specimen holder containing the specimen into the supporting framework and start the timer simultaneously. A maximum of five minutes shall elapse between the time the specimen is removed from the conditioning chamber until it is placed in position on the framework. During this time place the specimen and holder in an appropriate vapor barrier jacket, removing it only when the specimen and holder are placed on the framework for the test. A polyethylene bag has been found suitable as a vapor barrier envelope.

At 94, record the time of arrival of the flame on the surface of the specimen at each of the three inch marks on the specimen holder or on the corresponding lines of the specimen. At the same time, make the observations for "flash" required below. Also, record observations on dripping and any other behavior characteristics of the specimen that appear to be of interest. Record the maximum rise of the stack thermocouples.

At 96, the test is complete when the flame front has progressed to the fifteen inch mark or after an exposure time of fifteen minutes, whichever occurs first, provided the maximum temperature of the stack thermocouples is reached. If during the test of one or more of the test specimens, any of the following unusual behavior occurs: (1) excessive molten material flows out of the specimen holder; (2) one or more portions of a test specimen is forcefully displaced from the zone of controlled irradiance (explosive spalling); or (3) the test specimen swells sufficiently prior to ignition to touch the burner during combustion; the test is invalid. When a test on a specimen is invalid, test an additional specimen of the identical preconditioned test specimens. Do not incorporate data obtained from the tests noted above, yielding inadequate results, in the averaged data but report the occurrence.

Calculation At 98, the flame spread rating, $I_s$, of the test specimen is calculated. The flame spread rating, $I_s$, can be quantified as the product of the flame spread factor, $F_s$, and the heat evolution factor, Q, as follows:

$$I_s = F_s Q$$

where $F_s$ and Q are as defined below. The flame spread rating ($I_s$) reported shall be the value calculated as above for each of the four specimens tested. The average ($I_s$) of the four specimens shall be rounded to the nearest multiple of five.

On linear graph paper, plot distance vertically against time of arrival of flame at each mark horizontally. For this purpose, assume that the flame starts at zero inches at time zero minutes, and plot this initial point also. Connect the six (or fewer) points with straight-line segments. If the upward slope of all the line segments becomes less steep, or remains constant, calculate $F_s$ as follows:

$$F_s = 1 + \frac{1}{t_3 - t_0} + \frac{1}{t_6 - t_3} + \frac{1}{t_9 - t_6} + \frac{1}{t_{12} - t_9} + \frac{1}{t_{15} - t_{12}}$$

where $t_0$ is conventionally zero, and $t_3 \ldots t_{15}$ correspond to the time, in minutes, from initial specimen exposure until arrival of the flame front at the positions 3 . . . 15 inches, respectively, along the length of the specimen.

If there are any segments where the slope increases, eliminate the increase by drawing a straight line from the previous point to the succeeding point, thus "skipping" the point at which the slope increases. Thus, a "skip point" will always be located below the new line segment. Repeat this as often as necessary to eliminate slope increases. In some cases, it will be necessary to skip two, three or four consecutive points.

Points that are left below the final segmented curve are designated "skip points." Points on the curve are "curve points." There should be no points above the curve. Using the equation for $F_s$ given above, drop the two terms involving a single skip point, or the three to five terms involving two to four consecutive skip points, or both, and in each case replace them with the single new term $K/(T_f - T_b)$, where K is an integer related to the number of skip points, as follows:

| Number of skip points | K |
|---|---|
| One single | 4 |
| Two consecutive | 9 |
| Three consecutive | 16 |
| Four consecutive | 25 |

$T_f$=time in minutes at the first curve point following a skip point.

$T_b$=time in minutes at the last curve point before a skip point.

Procedures equivalent to the preceding, for example, computer programs, are equally valid. Calculate Q as follows:

$$Q = CT/\beta$$

where C is an arbitrary constant 5.7, chosen to make results consistent with those obtained prior to the metrication of this calculation, T is an observed maximum stack thermocouple temperature difference in degrees Celsius between the temperature time curve for the specimen and that for a similar curve of the inorganic reinforced cement board calibration specimen, and β is a mean stack thermocouple temperature rise for unit heat input rate of the calibration burner in degrees Celsius per kilowatt, a constant for the apparatus. In one example, β will be found to lie between 0.6 and 1.2° F./Btu min, or between 20 and 40° C./kW.

All flame fronts, however temporary, are to be taken into account. If flame spreads from any of the three inch marks to the next in three seconds or less, the fact shall be mentioned in the report and the word "Flashing" in parentheses shall follow the radiant panel index; it shall be reported in the form, for example, "Radiant panel index=100 (Flashing)."

Materials that have a tendency to exhibit rapid running or dripping of flaming material, either separately or in conjunction with a general flame front advance, due to melting and the steep inclination of the specimen during test, shall be noted as "Running (or Dripping) of Flaming Materials," and the time of occurrence shall be reported in addition to the regularly determined radiant panel index.

For low-density, cellular, or other materials in which flaming is rapid and is limited to the early part of the test exposure, it is possible for a slight temperature rise to remain undetected if recording is done intermittently. If the first test indicates such behavior, the test shall be deemed invalid, and additional tests shall be conducted by recording the stack thermocouple temperature at time intervals sufficiently small to ensure that no temperature rise values remain undetected; this can be achieved by taking recorder measurements every second or by using an appropriate data acquisition unit and computer.

It is to be appreciated by one skilled in the art that although various embodiments have been disclosed herein, other embodiments may be contemplated.

The invention claimed is:

1. A fan housing, comprising:

a unitary molded structure formed from a material that has a flame spread rating of twenty five or less, the unitary molded structure comprises, a base;

an impeller housing centrally located next to the base;

a flow path located circumferentially around the impeller housing with one or more defined walls for directing air flow;

an exhaust port that receives air from the flow path and outputs air in a particular direction;

an electrical enclosure that houses at least one electrical component; and a wiring channel located between the electrical enclosure and the impeller housing that provides a path for at least one connective wire to pass from the at least one electrical component within the electrical enclosure to one or more electrical components within the impeller housing.

2. The fan housing according to claim 1, further including:

at least one mounting hole for coupling one or more components to the fan housing to a surface.

3. The fan housing according to claim 1, further including:

a mounting hole for mounting at least one electrical component in the electrical enclosure to at least one external component; and a steel plate that surrounds the mounting hole to facilitate an attachment of the at least one connection.

4. The fan housing according to claim 1, further including:

a fan mounted with at least one blade, mounted to the impeller housing.

5. The fan housing according to claim 1, further including:

a fan housing cover that encloses the fan to prevent injury to a user.

6. The fan housing according to claim 1, further including:

a cross brace bracket that secures the fan housing to one or more structures.

7. The fan housing according to claim 1, further including:

at least one support fin that couples the flow path to the base to provide structural stability to the unitary molded structure.

8. The fan housing according to claim 1, further including:

an impeller motor located within the impeller housing that is operatively coupled to a fan that rotates to draw air from a space into the flow path and expels the air through the exhaust port.

9. The fan housing according to claim 1, further including:

at least one wire spring clip catch located adjacent to the base of the fan housing that allows at least one component to couple to the fan housing; and a wiring portal that allows one or more cables from one or more electrical components in the electrical enclosure to connect to at least one component coupled to the fan housing.

10. The fan housing according to claim 1, wherein the unitary molded component is comprised of at least one of a phenolic, a two-stage injection molded mineral filled phenolic, a thermoplastic, a thermoset, an elastomer, a plastic and a resin.

11. The fan housing according to claim 1, further including:

a PC board slot located adjacent to the electrical enclosure that accommodates a PC board utilized for at least one of processing data and providing control of one or more components associated with the fan housing.

12. The fan housing according to claim 1, wherein the flame spread rating is calculated by:

preparing a test specimen that is about six inches in height, about eighteen inches in length and about one inch in thickness;

placing the test specimen into a specimen holder;

igniting a gas-air mixture passing through a radiant panel;

measuring the radiant output of the radiant panel;

adjusting the rate of air and gas to provide a particular radiant output;

measuring the stack thermocouple temperature;

igniting the pilot;

positioning the pilot to contact the specimen;

recording the time of arrival of the pilot flame on the surface of the test specimen at each mark;

concluding the test when at least one of the last mark is reached and a predetermined maximum temperature is reached; and calculating the flame spread rating.

13. The fan housing according to claim 12, wherein the flame spread rating ($I_s$) is calculated as a function of $I_s=F_sQ$, wherein $F_s$ is calculated by $$F_s = 1 + \frac{1}{t_3 - t_0} + \frac{1}{t_6 - t_3} + \frac{1}{t_9 - t_6} + \frac{1}{t_{12} - t_9} + \frac{1}{t_{15} - t_{12}},$$

wherein where $t_0$ is zero, and $t_3$, $t_6$, $t_9$, $t_{12}$, and $t_{15}$ correspond to the time, in minutes, from initial specimen exposure until arrival of the flame front at the positions 3, 6, 9, 12, and 15 inches, respectively, along the length of the specimen, and Q is calculated by $Q=CT/\beta$, where C is an arbitrary constant 5.7, T is an observed maximum stack thermocouple temperature difference in degrees Celsius between the temperature time curve for the specimen and that for a similar curve of the inorganic reinforced cement board calibration specimen, and $\beta$ is a mean stack thermocouple temperature rise for unit heat input rate of the calibration burner in degrees Celsius per kilowatt.

14. A ventilation fan, comprising:

a unitary molded fan housing formed from a material that has a flame spread rating of twenty five or less;

an impeller having at least one fan blade and mounted to the unitary fan housing;

an impeller motor coupled to the impeller that rotates the impeller to draw air into the fan housing;

a flow path located circumferentially around the impeller with one or more defined walls for directing air flow;

an exhaust port that receives air from the flow path and outputs air in a particular direction;

an electrical enclosure that houses at least one electrical component; and a PC board slot located adjacent to the electrical enclosure that accommodates a PC board utilized for at least one of processing data and providing control of one or more components associated with the ventilation fan.

15. The ventilation fan according to claim 14, further including:

one of a light element and an air filtration unit operatively coupled to the unitary fan housing.

16. The ventilation fan according to claim 14, wherein the flame spread rating is calculated utilizing the following method:

preparing a test specimen that is about six inches in height, about eighteen inches in length and has a thickness of about one inch;

placing the test specimen into a specimen holder;

igniting a gas-air mixture passing through a radiant panel;

measuring the radiant output of the radiant panel;

adjusting the rate of air and gas to provide a particular radiant output;

measuring the stack thermocouple temperature;

igniting the pilot;

positioning the pilot to contact the specimen;

recording the time of arrival of the pilot flame on the surface of the test specimen at each mark;

concluding test when at least one of the last mark is reached and a predetermined maximum temperature is reached; and calculating the flame spread rating.

17. The fan housing according to claim 16, wherein the flame spread rating ($I_s$) is calculated as a function of $I_s=F_sQ$, wherein $F_s$ is calculated by $$F_s = 1 + \frac{1}{t_3 - t_0} + \frac{1}{t_6 - t_3} + \frac{1}{t_9 - t_6} + \frac{1}{t_{12} - t_9} + \frac{1}{t_{15} - t_{12}},$$

wherein where $t_0$ is zero, and $t_3$, $t_6$, $t_9$, $t_{12}$, and $t_{15}$ correspond to the time, in minutes, from initial specimen exposure until arrival of the flame front at the positions 3, 6, 9, 12, and 15 inches, respectively, along the length of the specimen, and Q is calculated by $Q=CT/\beta$, where C is an arbitrary constant 5.7, T is an observed maximum stack thermocouple temperature difference in degrees Celsius between the temperature time curve for the specimen and that for a similar curve of the inorganic reinforced cement board calibration specimen, and $\beta$ is a mean stack thermocouple temperature rise for unit heat input rate of the calibration burner in degrees Celsius per kilowatt.

18. The ventilation fan according to claim 14, further including:

a power supply that provides power to the impeller motor.

19. The ventilation fan according to claim 14, further including:

an electrical enclosure that houses at least one electrical component; and a wiring channel located between the electrical enclosure and the impeller that provides a path for at least one connective wire to pass from the at least one electrical component within the electrical enclosure to one or more electrical components within the unitary fan housing.

20. A method of manufacturing a bathroom fan, comprising:

forming a unitary housing unit with a phenolic material that has a flame spread rating of twenty five or less; and incorporating an impeller that comprises at least one fan blade within the unitary fan housing, an impeller motor coupled to the impeller that rotates the impeller to draw air into the fan housing, and a power supply that provides power to the impeller motor into the unitary housing unit.

* * * * *